US008230584B2

(12) United States Patent
Lindenthal et al.

(10) Patent No.: US 8,230,584 B2
(45) Date of Patent: Jul. 31, 2012

(54) METHOD FOR PRODUCING A COIL, IN PARTICULAR AN IGNITION COIL FOR A MOTOR VEHICLE

(75) Inventors: Konstantin Lindenthal, Blaichach (DE); Axel Keib, Oberstaufen (DE); Thomas Pawlak, Immenstadt (DE); Alfred Glatz, Sonthofen (DE)

(73) Assignee: Robert Bosch GmbH, Stuttgart (DE)

( * ) Notice: Subject to any disclaimer, the term of this patent is extended or adjusted under 35 U.S.C. 154(b) by 566 days.

(21) Appl. No.: 12/309,576

(22) PCT Filed: Aug. 2, 2007

(86) PCT No.: PCT/EP2007/058014

§ 371 (c)(1), (2), (4) Date: Aug. 4, 2009

(87) PCT Pub. No.: WO2008/017631

PCT Pub. Date: Feb. 14, 2008

(65) Prior Publication Data

US 2010/0018033 A1 Jan. 28, 2010

(30) Foreign Application Priority Data

Aug. 9, 2006 (DE) ..... 10 2006 037 169

(51) Int. Cl.
*H01F 7/06* (2006.01)

(52) U.S. Cl. ..... 29/605; 29/606; 336/83; 336/212; 336/234; 361/760; 361/761; 361/762

(58) Field of Classification Search ..... 29/602.1, 29/605, 606; 336/83, 212, 234; 361/760–766
See application file for complete search history.

(56) References Cited

U.S. PATENT DOCUMENTS

| | | | | |
|---|---|---|---|---|
| 6,191,675 | B1 | 2/2001 | Sudo et al. | |
| 6,655,707 | B2 * | 12/2003 | Buckmiller et al. | 280/279 |

FOREIGN PATENT DOCUMENTS

| | | | |
|---|---|---|---|
| DE | 11 21 408 | | 1/1962 |
| DE | 23 46 346 | | 4/1975 |
| DE | 40 40 604 | | 6/1992 |
| DE | 200 12 401 | | 1/2002 |
| DE | 203 12 503 | | 12/2003 |
| DE | 102 47 411 | | 4/2004 |
| EP | 0 340 083 | | 11/1989 |
| JP | 1-144476 | | 6/1989 |
| JP | 7-7897 | | 1/1995 |
| JP | 2102706 | | 10/1996 |
| JP | 10080724 | A * | 3/1998 |
| JP | 11-111546 | | 4/1999 |
| JP | 11-224823 | | 8/1999 |
| WO | WO 2006/075464 | | 7/2006 |

* cited by examiner

*Primary Examiner* — Paul D Kim
(74) *Attorney, Agent, or Firm* — Kenyon & Kenyon LLP

(57) ABSTRACT

A method for producing a coil, in particular an ignition coil for a motor vehicle, in which a primary winding is wound onto a winding mandrel. Then the winding mandrel is introduced into a housing of the coil and the winding mandrel then is removed from the housing, the primary winding remaining inside the housing. Finally, additional components of the coil, in particular a secondary coil shell onto which a secondary winding has been wound, are introduced into the housing, so that the secondary winding is concentrically disposed within the primary winding while dispensing with a separate primary coil shell. The method allows a design of the coil that is more compact in diameter.

11 Claims, 3 Drawing Sheets

METHOD FOR PRODUCING A COIL, IN PARTICULAR AN IGNITION COIL FOR A MOTOR VEHICLE

BACKGROUND INFORMATION

A coil having a longitudinal coil housing is described in German Patent No. DE 200 12 401 U1. A plurality of preassembled modules or components are installed inside the coil housing. Among these components are, for example, a rod-shaped magnetic core, which is concentrically surrounded by a secondary coil shell having a secondary winding, and by a primary coil shell having a primary winding. Once the components and modules have been assembled and installed inside the coil housing, the coil housing is filled with an insulating resin. Such an ignition coil is installed in the cylinder head of the engine into a corresponding receiving bore and brought into contact with the spark plug of the internal combustion engine. Since the space in the cylinder head of the internal combustion engine is limited, the receiving bore for the ignition coil is likewise limited in its diameter. This is in conflict with the requirement of providing the highest possible ignition energy for the spark plug because this would require a spark plug whose diameter is also as large as possible with respect to the available space.

In addition, a primary wire winding for a rod-type ignition coil that is optimized with respect to its installation space is described in German Patent No. DE 102 47 411. In a first working step, the primary wire for a primary winding is wound onto a mandrel, which simultaneously serves as internal component for an injection-molding die. The primary winding including the mandrel is then extrusion-coated by plastic, the plastic simultaneously forming the outer housing of the rod-type ignition coil. Thus, the known primary winding enables a very advantageous design with regard to its radial extension because a separate primary coil shell that enlarges the diameter of the rod-type ignition coil, as well as an outer housing are dispensed with.

SUMMARY OF THE INVENTION

The method according to the present invention for producing a coil, especially an ignition coil for a motor vehicle, has the advantage that it allows a simple and cost-effective production while reducing the space by dispensing with a separate primary coil shell.

To enable the simplest possible contacting of the ends of the primary winding with the components contacting the primary winding in the coil, one further development of the present invention provides for the inclusion of a connection ring, which is connected to the ends of the primary winding in advance and which is inserted into the housing of the coil together with the winding mandrel.

To provide better electric insulation between the secondary winding and the primary winding, it is also advantageous to provide an intermediate layer between the primary winding and the secondary winding, which is already applied onto the winding mandrel before the primary winding is wound onto the winding mandrel.

Moreover, especially satisfactory insulating characteristics are obtained if the housing or the gaps in the housing are filled with an insulating resin once the individual components have been assembled.

In order to achieve a particularly satisfactory transfer or strip-off of the primary winding in the housing of the coil, another advantageous development provides an additional strip-off element, which holds or fixes the primary winding in place when the winding mandrel is pulled out of the housing of the coil.

Instead of a strip-off element, it is also conceivable to provide the winding mandrel with a variable diameter, such that the diameter of the winding mandrel is reduced for the pullout of the winding mandrel, thereby releasing the adhesion or connection between the winding mandrel and the primary winding when pulling the winding mandrel out of the housing.

DETAILED DESCRIPTION

Figure 1:
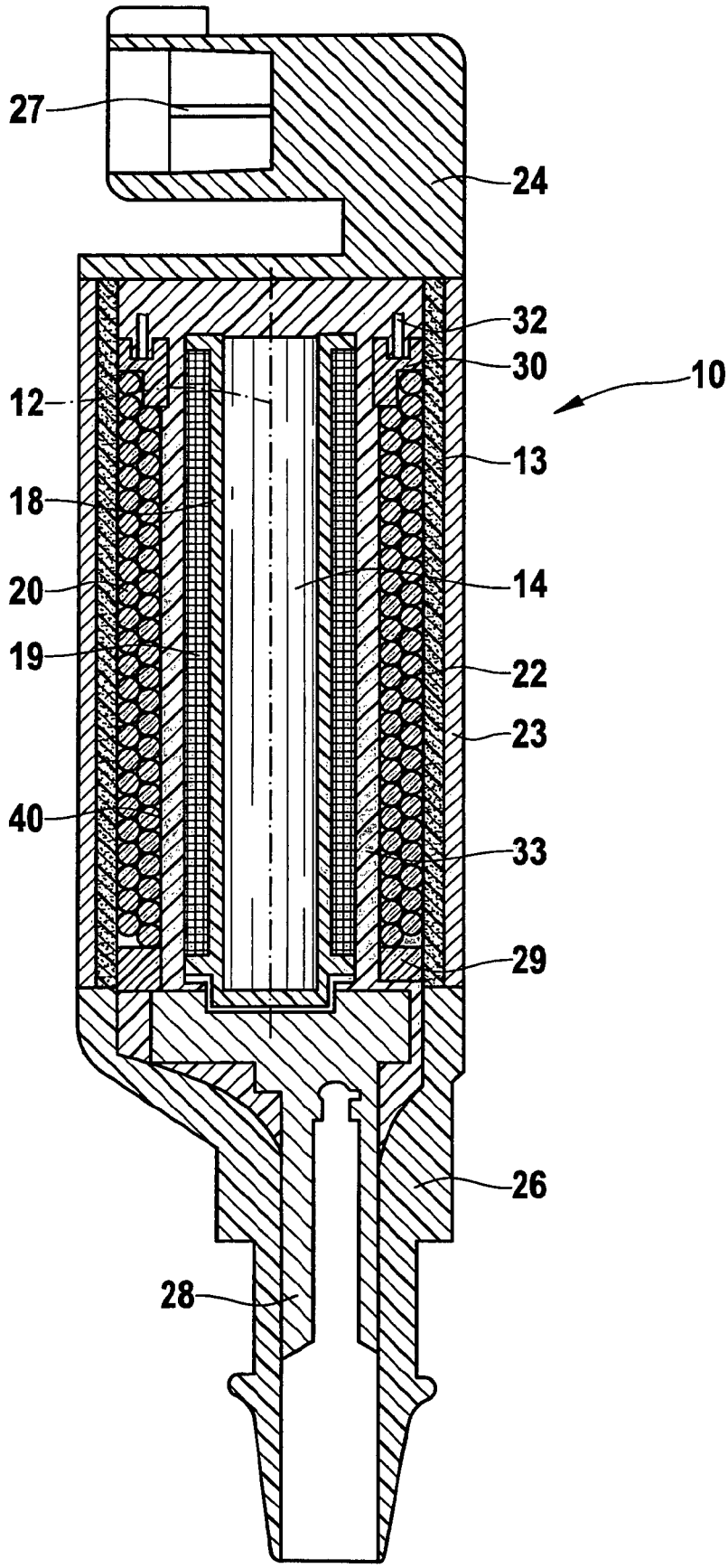
FIG. 1 shows an ignition coil in a simplified longitudinal section.

Rod-type coil 10 shown in FIG. 1 is used especially as an ignition coil in internal combustion engines of motor vehicles and is provided for direct contacting with a spark plug (not shown), which in turn is inserted into a shaft in the cylinder head of the internal combustion engine together with rod-type coil 10. In a plastic housing 13, rod-type coil 10 contains an elongated cylindrical core 14, which is also referred to as an I-core and is situated coaxially with respect to a longitudinal axis 12, in a central position. Core 14 is made of a layered, magnetizable material and is part of an open magnetic circuit.

A secondary winding 19 carrying a high voltage is positioned concentrically about core 14, on a secondary coil shell 18. Secondary winding 19 is surrounded by a primary winding 20. Primary winding 20 is surrounded at a short radial distance by a cylindrical segment 22 of housing 13, the central segment of the housing having a longitudinal extension adapted to windings 19, 20. Central segment 22 of housing 13 is in turn enveloped without radial play by a longitudinally slit, sleeve-shaped, sheet-metal yoke 23, which forms the outer sleeve of rod-type coil 10 in this region of the coil. As a yoke element of the magnetic circuit of rod-type coil 10, sheet-metal yoke 23 is used for conducting the magnetic field and is also referred to as an outer core.

Situated contiguously to central section 23 of housing 13 are, on one end, a first end segment 24 of housing 13 and, on the other end, a second end segment 26 of housing 13. Disposed in first end segment 24 are metallic connector plugs 27, via which primary winding 20 of rod-type coil 10 is supplied with low voltage. Second end segment 26 includes a metallic connector sleeve 28 connected to secondary winding 19, via which the high voltage of rod-type coil 10 is shunted to the spark plug (not shown).

Primary winding 20 radially disposed at least close to the inner wall of housing 13 is delimited in the axial direction on the side facing second end segment 26 by a ring 29 preferably made of plastic. On the side facing first end segment 24, a connection ring 30 is provided, which is connected on one side to primary winding 20 and on the other side to connector plugs 27 via a connection wire 32. If necessary, a contour may be worked into connection ring 30 to guide primary winding 20.

The interior of housing 13 is preferably filled with insulating resin 33, which in particular also fills up the radial gap between primary winding 20 and secondary winding 19 lying opposite thereof.

For the installation of rod-type coil 10, primary winding 20 must first be positioned inside housing 13 before it is fitted with the other components, e.g., secondary winding 19 or core 14. According to FIG. 2, a winding mandrel 35 is used for this purpose. Winding mandrel 35 has a cylindrical or preferably slightly conical form at least in the region provided for primary winding 20. The length of winding mandrel 35 is to be dimensioned such that at least primary winding 20 as well as ring 29 and connection ring 30 are able to be accommodated thereon. The inner diameter of ring 29 and connection ring 30 should be adapted to the outer diameter of winding mandrel 35 in such a way that it is easy to strip ring 29 and connection ring 30 off in the axial direction of winding mandrel 35. Preferably, ring 29 and connection ring 30 are first positioned on winding mandrel 35 at the proper distance from one another, whereupon the wire of primary winding 30 is wound onto winding mandrel 35 in at least one layer between ring 29 and connection ring 30. This is accomplished either in that winding mandrel 35 is rotatable and displaceable in the axial direction relative to a wire delivery device (not illustrated), or else preferably in that in the case of a stationary winding mandrel 35, the wire delivery device rotates about winding mandrel 35 and in so doing simultaneously moves in the axial direction of winding mandrel 35.

Once primary winding 20 has been wound onto winding mandrel 35, wire ends 36, 37 of primary winding 20 are electrically contacted to connection ring 30, for instance by welding. In order to provide a certain connection or adhesion between the individual layers of primary winding 20, the wire of primary winding 20 may be provided in the form of what is known as baked enamel wire. The baked enamel layer of primary winding 20 is activated by appropriate thermal treatment, so that primary winding 20 subsequently forms a compact, fixed unit.

Figure 2:
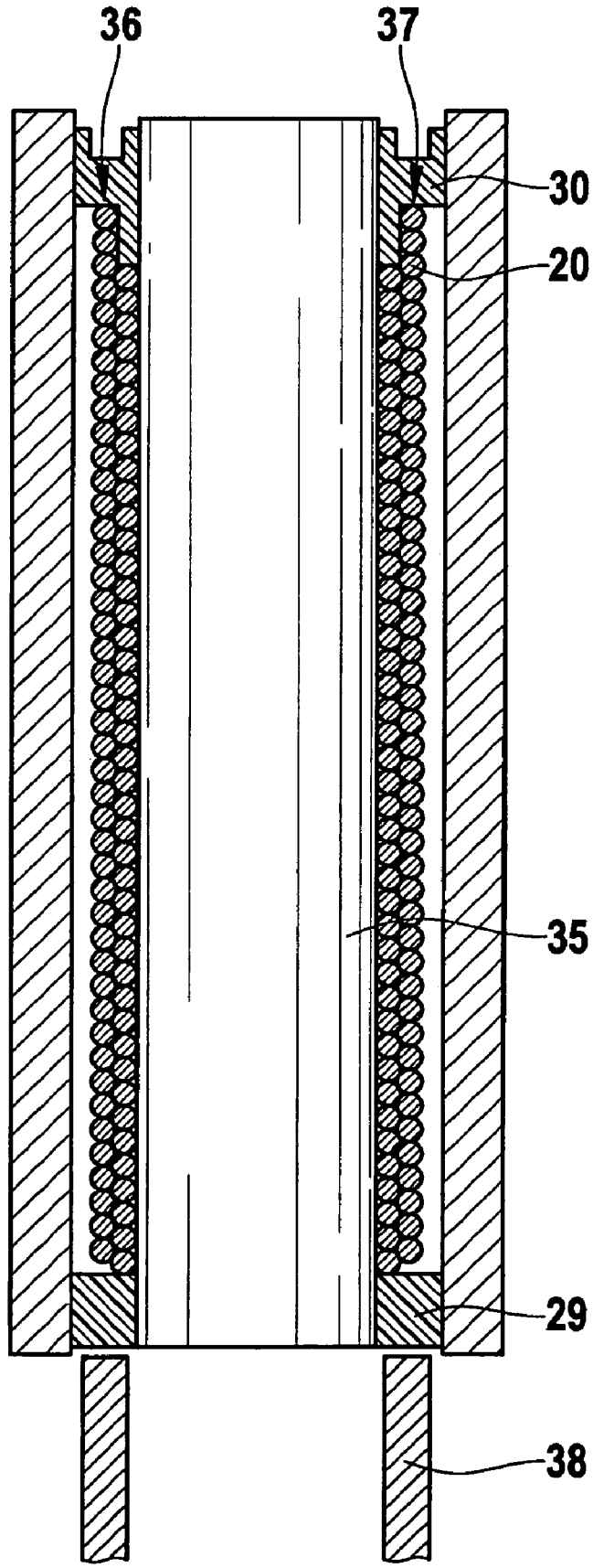
FIG. 2 shows a longitudinal section through a first winding mandrel having a primary winding wound onto the winding mandrel.

Then winding mandrel 35 together with primary winding 20 is slipped into housing 13 until primary winding 20 is located at the intended position inside housing 13 (FIG. 2). To strip off primary winding 20 in housing 13, winding mandrel 35 or ring 29 then cooperates with a strip-off element 38, which is tubular in an exemplary embodiment and which remains in stationary contact with ring 29 when winding mandrel 35 is pulled out of housing 13, whereas winding mandrel 35 is displaceable in relation thereto in the longitudinal direction of housing 13. In an advantageous manner, winding mandrel 35 has a slightly conical design to facilitate the strip-off operation of primary winding 20 from winding mandrel 35, such that the diameter of winding mandrel 35 gets smaller when viewed in the direction of connection ring 30.

Once winding mandrel 35 has been removed from housing 13, additional components of rod-type coil 10 may be inserted into housing 13, and connection wires 32 may be connected to connection ring 30. Finally, the interior of housing 13 may be filled with insulating resin 33, if appropriate.

In order to improve the electrical insulating properties between primary winding 20 and secondary winding 19, or to facilitate the stripping off of primary winding 20 from winding mandrel 35, an additional intermediate layer 40 may be provided (FIG. 1). Intermediate layer 40 is made up of a possibly coated paper or plastic foil layer, which may be perforated, if necessary. Intermediate layer 40 is applied on winding mandrel 35 first before primary winding 20 is wound onto winding mandrel 35, and then it is stripped off together with primary winding 20 in housing 13.

Figure 3:
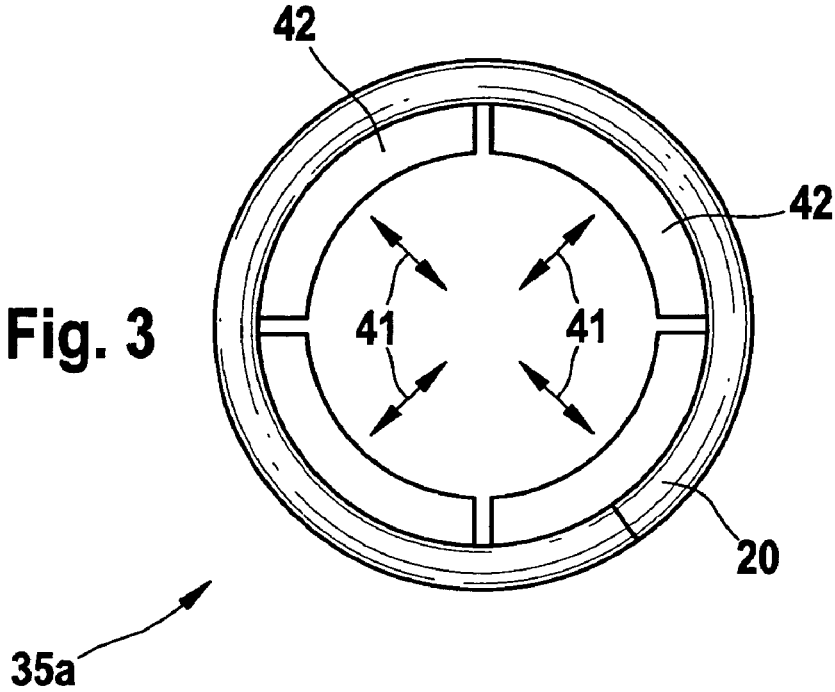
FIGS. 3 and 4 show cross sections through a second winding mandrel during different working positions.
Figure 4:
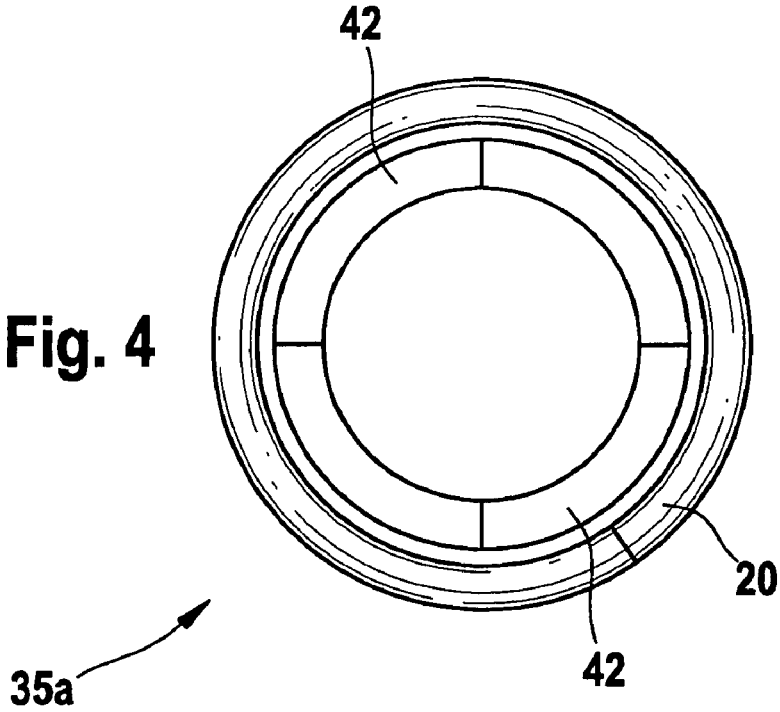

In contrast to rigid winding mandrel 35, a modified winding mandrel 35*a* is shown in FIGS. 3 and 4. Winding mandrel 35*a* is characterized by having a variable diameter. In the example shown, this is realized by segments 42 which are displaceable in the direction of double arrows 41, but other developments are of course conceivable as well. To wind up primary winding 20 or intermediate layer 40, winding mandrel 35*a* has its largest diameter according to FIG. 3. To strip off primary winding 20 or intermediate layer 40 in housing 13, the diameter of winding mandrel 35*a* according to FIG. 4 is reduced, so that the adhesion of intermediate layer 40 or primary winding 20 to winding mandrel 35*a* is canceled. In the case of modified winding mandrel 35*a*, it may be possible to dispense with strip-off element 38.

What is claimed is:

1. A method for producing a coil, comprising:
winding a primary winding onto a winding mandrel;
introducing the winding mandrel into a housing of the coil;
removing the winding mandrel from the housing, the primary winding remaining inside the housing;
introducing additional components of the coil into the housing, so that a secondary winding is concentrically situated within the primary winding while dispensing with a separate primary coil shell;
connecting an end or a beginning of the primary winding to an annular connection element; and
mounting the connection element together with the primary winding on the winding mandrel, the connection element remaining inside the housing for a contacting of the primary winding with a supply voltage of the coil.

2. The method according to claim 1, wherein the coil is an ignition coil of a motor vehicle.

3. The method according to claim 1, wherein the additional components include a secondary coil shell onto which the secondary winding is wound.

4. The method according to claim 1, further comprising filling a clearance space inside the housing between the secondary winding and the primary winding with an insulating resin.

5. A method for producing a coil, comprising:
winding a primary winding onto a winding mandrel;
introducing the winding mandrel into a housing of the coil;
removing the winding mandrel from the housing, the primary winding remaining inside the housing;
introducing additional components of the coil into the housing, so that a secondary winding is concentrically situated within the primary winding while dispensing with a separate primary coil shell; and
applying an intermediate layer on the winding mandrel between the winding mandrel and the primary winding, the intermediate layer remaining in the housing together with the primary winding.

6. The method according to claim 5, wherein the coil is an ignition coil of a motor vehicle.

7. The method according to claim 5, wherein the additional components include a secondary coil shell onto which the secondary winding is wound.

8. The method according to claim 5, further comprising filling a clearance space inside the housing between the secondary winding and the primary winding with an insulating resin.

9. A device comprising:
a coil including a housing;
a primary winding including a wire;
a strip-off element; and
a winding mandrel onto which the wire of the primary winding is wound, the winding mandrel cooperating with the strip-off element for stripping off the primary winding inside the housing of the coil, the winding mandrel and the strip-off element being displaceable relative to one another.

10. The device according to claim 9, wherein the strip-off element acts on a retaining element, which is situated on a side of the primary winding lying opposite a connection element.

11. The device according to claim 9, wherein the winding mandrel has a conical shape in a region of the primary winding.

* * * * *